United States Patent [19]

Seabury

[11] Patent Number: 4,745,868

[45] Date of Patent: May 24, 1988

[54] SYSTEM FOR AND METHOD OF PRODUCING A BENEFICIATED FUEL

[76] Inventor: Samuel W. Seabury, 6735 Ellsworth, Dallas, Tex. 75214

[21] Appl. No.: 843,186

[22] Filed: Mar. 21, 1986

[51] Int. Cl.[4] ..... F23B 7/00

[52] U.S. Cl. ..... 110/234; 110/226; 110/347

[58] Field of Search ..... 110/224, 232, 347, 226, 110/234

[56] References Cited

U.S. PATENT DOCUMENTS

| | | | |
|---|---|---|---|
| 2,171,535 | 9/1939 | Berg et al. | 110/226 |
| 2,677,235 | 5/1954 | Secord | 110/232 X |
| 2,700,830 | 2/1955 | Wolfe | 34/65 |
| 3,572,665 | 3/1971 | Vincent | 263/40 |
| 3,707,129 | 12/1972 | Kawashimo et al. | 110/15 |
| 3,841,100 | 10/1974 | Fortescue et al. | 60/690 |
| 3,954,069 | 5/1976 | Loken | 110/8 R |
| 3,976,018 | 8/1976 | Boulet | 110/10 |
| 3,978,657 | 9/1976 | Fulton et al. | 60/39.12 |
| 3,986,348 | 10/1976 | Switzer | 60/39.02 |
| 4,059,060 | 11/1977 | Gambs et al. | 110/232 |
| 4,089,277 | 5/1978 | Paul | 110/204 |
| 4,146,361 | 3/1979 | Cirrito | 432/60 |
| 4,185,456 | 1/1980 | Cummings | 60/39.02 |
| 4,359,006 | 11/1982 | Have | 110/346 |
| 4,387,560 | 6/1983 | Hamilton et al. | 60/39.02 |
| 4,387,561 | 6/1983 | Hamilton | 60/39.02 |
| 4,409,909 | 10/1983 | Tomipawa et al. | 110/346 |
| 4,431,405 | 2/1984 | Eatherton | 432/72 |
| 4,474,011 | 10/1984 | Nelson et al. | 60/648 |
| 4,476,684 | 10/1984 | Phillips | 60/689 |
| 4,478,039 | 10/1984 | Horgan | 60/39.02 |
| 4,485,745 | 12/1984 | Bracker et al. | 110/229 |
| 4,516,511 | 5/1985 | Kuo | 110/224 X |
| 4,530,700 | 7/1985 | Sawyer et al. | 44/1 |
| 4,541,345 | 9/1985 | Grumpett et al. | 110/229 |
| 4,542,703 | 9/1985 | Przewalski | 110/246 |
| 4,566,267 | 1/1986 | Muller et al. | 60/39.07 |
| 4,569,194 | 2/1986 | Giles et al. | 60/39.02 |
| 4,569,197 | 2/1986 | Adrian et al. | 60/39.02 |
| 4,571,175 | 2/1986 | Bogle et al. | 432/14 |
| 4,589,357 | 5/1986 | Lincoln et al. | 110/347 |
| 4,590,868 | 5/1986 | Ishihara | 110/347 |
| 4,597,257 | 7/1986 | Schuster et al. | 60/39.12 |

*Primary Examiner*—Edward G. Favors

*Attorney, Agent, or Firm*—Harry C. Post, III

[57] ABSTRACT

A system for and method of producing a beneficiated fuel from a raw low ranked moisture ladened fuel. A combustion turbine is operated to provide a flow of exhaust gas out of an exhaust outlet at a temperature above ambient. The flow of exhaust gas is then directed across the raw low ranked moisture ladened fuel such that a portion of the moisture carried by the raw fuel is removed to produce the beneficiated fuel.

18 Claims, 1 Drawing Sheet

SYSTEM FOR AND METHOD OF PRODUCING A BENEFICIATED FUEL

Figure 1:
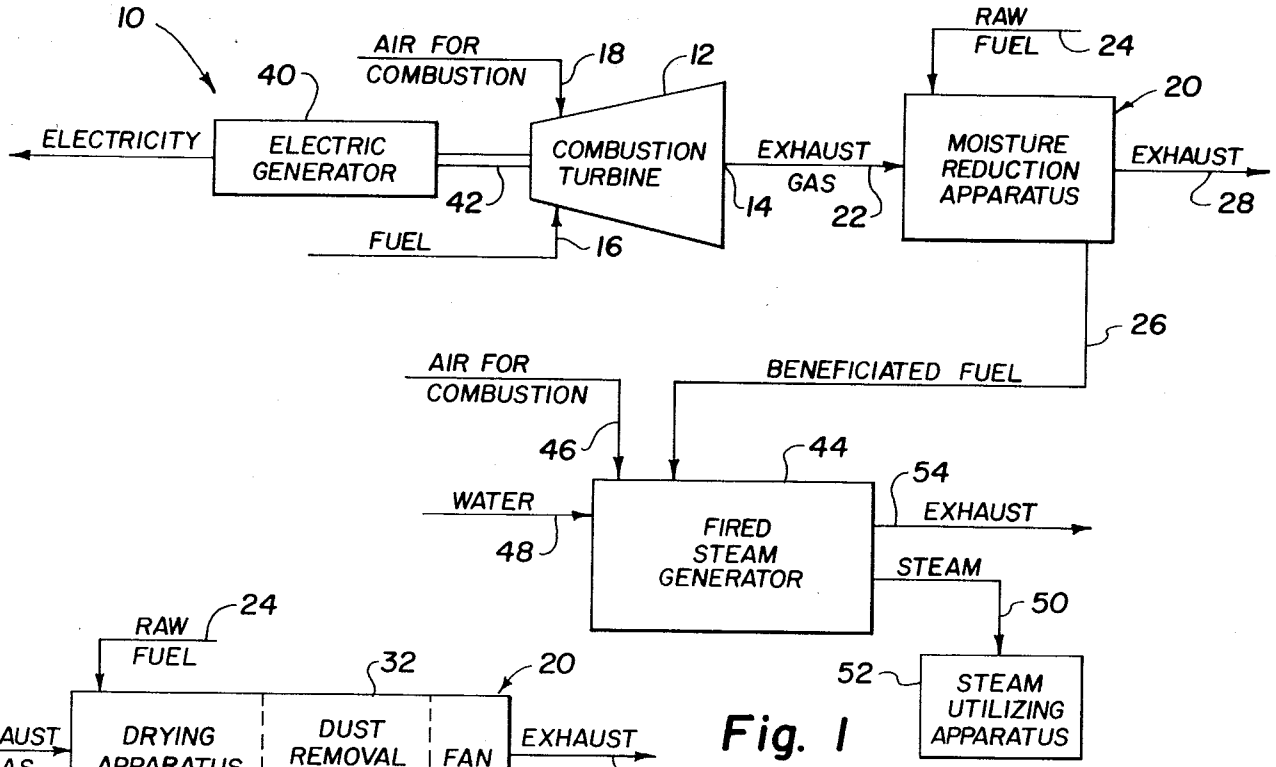

It is well known, that low ranked fuels, such as subbituminous, lignite, brown coal and peat, are plentiful in some geographic areas and not in others. Although plentiful, these fuels are not being utilized as extensively as desired in these areas because the fuels have a high moisture content.

Accordingly, it is an object of the present invention to produce a beneficiated fuel from a raw low ranked moisture ladened fuel.

Further, it is an object of the present invention to generate electricity while producing the beneficiated fuel to employ a combined cycle.

Further, it is an object of the present invention to fire the beneficiated fuel in a steam generator to produce steam.

Further, it is an object of the present invention to provide a combined cycle of generating electricity while producing the beneficiated fuel and to fire the beneficiated fuel in a steam generator to produce steam.

Further, it is an object of the present invention to utilize the steam produced from the steam generator and to generate electricity while producing the beneficiated fuel.

In accordance with the invention, a system produces a beneficiated fuel from a raw low ranked moisture ladened fuel. A combustion turbine is used in the system for flowing exhaust gas out of an exhaust outlet at a temperature above ambient. A moisture reduction apparatus is connected to the exhaust outlet of the combustion turbine to receive the flowing exhaust gas for directing the exhaust gas across the raw low ranked moisture ladened fuel, which removes a portion of the moisture carried by the raw fuel to produce the beneficiated fuel.

Further, in accordance with the invention, a method produces a beneficiated fuel from a raw low ranked moisture ladened fuel. A combustion turbine is operated in the method to provide a flow of exhaust gas out of an exhaust outlet at a temperature above ambient. The flow of exhaust gas from the combustion turbine is directed across the raw low ranked moisture ladened fuel, which removes a portion of the moisture carried by the raw fuel to produce the beneficiated fuel.

Figure 2:
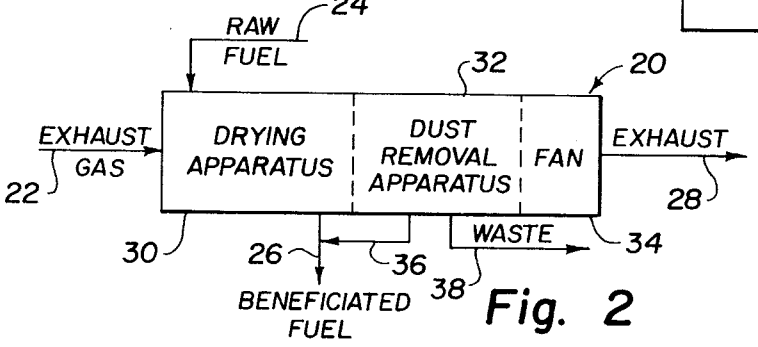

Other objects and advantages of the invention will become apparent upon reading the following detailed description and upon reference to the drawings, wherein like reference characters are used throughout to designate like parts:

FIG. 1 is a schematic drawing of a system for and method of producing a beneficiated fuel from a raw low rnaked moisture ladened fuel constructed in accordance with the present invention; and FIG. 2 is a schematic drawing of a moisture reduction apparatus, which may be used in the system and method shown in FIG. 1.

Turning now to the drawing, there is shown in FIG. 1 a system and method 10 for producing a beneficiated fuel from a raw low ranked moisture ladened fuel. System and method 10 removes a portion of the moisture carried by the raw low ranked moisture ladened fuel, such as subbituminous, lignite, brown coal and peat. Preferably, the system and method 10 is used to remove a portion of the moisture carried by a raw low ranked moisture ladened fossil fuel, such as subbituminous, lignite and brown coal.

A combustion turbine 12 is operated in system and method 10 to provide a continuous flow of exhaust gas out of an exhaust outlet 14. Combustion turbine 12 is of conventional design and receives a fluid fuel through feed line 16 for burning in air supplied through line 18. The exhaust gas flowing out of exhaust outlet 14 includes air and the products of combustion and should be well above the ambient temperature to provide a drying atmosphere for the raw fuel. It is believed that a desired drying atmosphere is obtained by operating the combustion turbine to provide exhaust gas with a temperature at exhaust outlet 14 between 400° F. and 1200° F. It is preferred that the exhaust gas have a temperature at exhaust outlet 14 of between 500° F. and 1000° F.

A moisture reduction apparatus 20 is connected, such as by a conduit 22, to the exhaust outlet 14 of combustion turbine 12 to receive the continuously flowing exhaust gas and provide a closed system. Moisture reduction apparatus 20 is of conventional design that directs the exhaust gas flow across the raw low ranked moisture ladened fuel continuously carried to apparatus 20 by conveying line 24, the beneficiated fuel being continuously removed from apparatus 20 by conveying line 26, and the exhaust gas being released to the atmosphere or directed to a treatment plant through line 28. It is believed that a desired drying operation is obtained by operating system and method 10 to provide exhaust gas at system outlet 28 with a temperature of between 100° F. and 400° F. It is preferred that the exhaust gas at system outlet 28 have a temperature of between 130° F. and 250° F. Further, it is believed that a desired drying operation is obtained by operating system and method 10 to provide exhaust gas at system outlet 28 with a relative humidity no greater than 75%. When the beneficiated fuel being produced is from a low ranked moisture ladened fossil fuel, it is believed that a desired drying operation is obtained by operating system and method 10 so that the raw fuel will have from 3 to 20% by weight removed as water and the beneficiated fuel will have a temperature of no more than 200° F. to prevent inadvertent combustion of the beneficiated fuel.

As shown in FIG. 2, moisture reduction apparatus 20 may employ a drying apparatus 30, a dust removal apparatus 32 and a fan apparatus 34. Drying apparatus 30 is of conventional design, such as a counter rotary drum dryer, a parallel rotary drum dryer or a fluidized bed dryer. It is preferred that drying apparatus 30 is used to continuously move the raw fuel relative to the continuously flowing exhaust gas from conduit 22. Further, it is preferred that drying apparatus 20 is a rotary drum dryer positioned to move the raw fuel in the same direction as the flowing exhaust gas and to tumble the raw fuel. Dust removal apparatus 32 is of conventional design, such as used in a bag house, cyclone collector and venturi scrubber, which removes particulate matter from the exhaust gas after the exhaust gas has moved past rotary drum dryer 30. After the particulate matter has been separated from the exhaust gas in dust removal apparatus 32, the separated particulate matter may be added through line 36 to beneficiated fuel line 26 or the separated particulate matter may be removed from system and method 10 by line 38 as waste. Fan apparatus 34 is of conventional design for providing a balanced draft system to inhibit particulate matter from escaping into the atmosphere before passing through dust collector 32. It is preferred that the balanced draft system is regulated with a pressure differential of no greater than 10 inches of water existing between the pressure of the gas flowing out of exhaust outlet 14 of combustion turbine 12 and the pressure of the gas flowing out of system exhaust through line 28.

System and method 10 may include a conventional electrical generator 40 mechanically joined to combustion turbine 12 by coupling 42, so that electricity is provided while providing the exhaust gas to remove the portion of moisture from the raw fuel.

System and method 10 may include a conventional steam generator 44, which fires or burns the beneficiated fuel received from moisture reducing apparatus 20 via line 26 within air received through line 46. Water is supplied through line 48 to steam generator 44 and steam is carried from steam generator 44 through line 50 to a steam utilizing apparatus 52, such as a chemical plant or steam driven electrical generator. The exhaust gases generated by firing the beneficiated fuel are exhausted through line 54 to the atmosphere or to a plant for treatment.

The invention having been described, what is claimed is:

1. A system for producing a beneficiated fuel from a raw low ranked moisture ladened fuel, comprising: combustion turbine means for flowing exhaust gas out of an exhaust outlet at a temperature above ambient; and moisture reduction means connected to the exhaust outlet of said combustion turbine means to receive the flowing exhaust gas from the exhaust outlet of said combustion turbine means for directing the exhaust gas across the raw low ranked moisture ladened fuel such that a portion of the moisture carried by the raw fuel is removed to produce the beneficiated fuel, said moisture reduction means including drying means disposed to receive the exhaust gas flowing from the combustion turbine for continuously moving the raw fuel through the received exhaust gas, the drying means including a drum rotary dryer means for moving the raw fuel in the same direction as the flowing exhaust gas while tumbling the raw fuel being processed, dust collecting means receiving the exhaust gas from the rotary drum dryer means for removing particulate matter from the exhaust gas after the exhaust gas has moved past the rotary drum dryer means, and fan means receiving the exhaust gas from the dust collecting means for providing a balanced draft system.

2. A system as set forth in claim 1, further comprising: the temperature of the gas exhausting out of the exhaust outlet being between 400° F. and 1200° F.

3. A system as set forth in claim 2, further comprising: the temperature of the gas exhausting out of the exhaust outlet being between 500° F. and 1000° F.

4. A system as set forth in claim 1, further comprising: said moisture reduction means including a system outlet, the temperature of the gas exhausting out of the system outlet being between 100° F. and 400° F.

5. A system as set forth in claim 4, further comprising: the temperature of the gas exhausting out of the system outlet being between 130° F. and 250° F.

6. A system as set forth in claim 1, further comprising: the beneficiated fuel being produced from a low ranked moisture ladened fossil fuel, the raw fuel having from 3 to 20% by weight as water and the beneficiated fuel having a temperature no more than 200° F.

7. A system as set forth in claim 1, further comprising: the exhaust gas flowing out of the exhaust outlet of said combustion turbine means having a first pressure, the gas flowing out of a system exhaust having a second pressure, the first and second pressures having a differential of no greater than 10 inches of water.

8. A system as set forth in claim 1, further comprising: electric generating means connected to said combustion turbine means for generating electricity.

9. A method of producing a beneficiated fuel from a raw low ranked moisture ladened fuel, comprising: operating a combustion turbine to provide a flow of exhaust gas out of an exhaust outlet at a temperature above ambient; directing the flow of exhaust gas from the combustion turbine across the raw low ranked moisture ladened fuel such that a portion of the moisture carried by the raw fuel is removed to produce the beneficiated fuel; moving the raw fuel in the same direction as the flowing exhaust gas; tumbling the raw fuel being processed while the raw fuel is being moved in the same direction as the flowing exhaust gas; removing particulate matter from the exhaust gas after the raw fuel has been moved and tumbled; and providing a balanced draft system by drawing the gas from the exhaust outlet of the combustion turbine and forcing the gas out of the system.

10. A method as set forth in claim 9, further comprising: operating the combustion turbine to provide exhaust gas with a temperature at the exhaust outlet of between 400° F. and 1200° F.

11. A method as set forth in claim 10, further comprising: operating the combustion turbine to provide exhaust gas with a temperature at the exhaust outlet of between 500° F. and 1000° F.

12. A method as set forth in claim 9, further comprising: operating the combustion turbine to provide gas flowing out of the system at a temperature at the system outlet of between 100° F. and 400° F.

13. A method as set forth in claim 12, further comprising: operating the combustion turbine to provide gas flowing out of the system at a temperature at the system outlet of between 130° F. and 250° F.

14. A method as set forth in claim 9, further comprising: the raw low ranked moisture ladened fuel being a fossil fuel, the flow of exhaust gas being directed across the raw low ranked moisture ladened fuel sufficiently to remove from 3 to 20% by weight as water and produce the beneficiated fuel having a temperature not to exceed 200° F.

15. A method as set forth in claim 9, further comprising: the balanced draft system being regulated with a pressure differential of no greater than 10 inches of water existing between the pressure of the gas flowing out of the exhaust outlet of the combustion turbine and the pressure of the gas flowing out of the system exhaust.

16. A method as set forth in claim 15, further comprising: generating electrical power by the combustion turbine driving an electrical generator while providing the flow of exhaust gas.

17. A system for producing a beneficiated fuel from a raw low ranked moisture ladened fossil fuel, comprising: combustion turbine means for flowing exhaust gas out of an exhaust outlet at a temperature of between 500° F. and 1000° F.; electric generating means connected to said combustion turbine means for generating electricity; moisture reduction means connected to the exhaust outlet of said combustion turbine means to receive the flowing exhaust gas from the exhaust outlet of said combustion turbine means for directing the exhaust gas across the raw low ranked moisture ladened fuel such that a portion of the moisture carried by the raw fuel is removed to produce the beneficiated fuel, said moisture reduction means including a system outlet and drying means receiving the exhaust gas flowing from the combustion turbine and continuously moving the raw fuel through the received exhaust gas, the drying means including a drum rotary dryer means for mving the raw fuel in the same direction as the flowing exhaust gas while tumbling the raw fuel being processed, said moisture reduction means further including dust collecting means receiving the exhaust gas from the rotary drum dryer means for removing particulate matter from the exhaust gas after the exhaust gas has moved past the rotary drum dryer means, said moisture reduction means further including fan means receiving the exhaust gas from the dust collecting means for providing a balanced draft system, the exhaust gas flowing out of the exhaust outlet of said combustion turbine means having a first pressure, the gas flowing out of a system exhaust having a second pressure, the first and second pressures having a differential of no greater than 10 inches of water, the temperature of the gas exhausting out of the system outlet being between 130° F. and 250° F., the raw fuel having from 3 to 20% by weight as water and the beneficiated fuel having a temperature no more than 200° F.; steam producing means receiving the beneficiated fuel from said moisture reduction means for producing steam generated by firing the beneficiated fuel; and steam utilizing means receiving steam from said steam producing means for utilizing the steam generated from firing the beneficiated fuel.

18. A method of producing a beneficiated fuel from a raw low ranked moisture ladened fossil fuel, comprising: operating a combustion turbine to provide a flow of exhaust gas out of an exhaust outlet at a temperature of between 500° F. and 1000° F. and to provide gas flowing out of the system at a temperature at the system outlet of between 130° F. and 250° F.; directing the flow of exhaust gas from the combustion turbine across the raw low ranked moisture ladened fuel such that a portion of the moisture carried by the raw fuel is removed to produce the beneficiated fuel, the flow of exhaust gas being directed across the raw low ranked moisture ladened fuel sufficiently to remove from 3 to 20% by weight as water and produce the beneficiated fuel having a temperature not to exceed 200° F.; moving the raw fuel in the same direction as the flowing exhaust gas; tumbling the raw fuel being processed after the raw fuel has been moved and tumbled; providing a balanced draft system by drawing the gas from the exhaust outlet of the combustion turbine and forcing the gas out of the system after the particulate matter has been removed, the balanced draft system being regulated with a pressure differential of no greater than 10 inches of water existing between the pressure of the gas flowing out of the exhaust outlet of the combustion turbine and the pressure of the gas flowing out of the system exhaust; generating electrical power by the combustion turbine driving an electrical generator while providing the flow of exhaust gas; conveying the beneficiated fuel to a steam generator; firing the beneficiated fuel in the steam generator to produce steam; directing the steam produced by firing the beneficiated fuel to a steam utilizing device; and utilizing the steam produced by firing the beneficiated fuel.

* * * * *